United States Patent [19]

Sparrow, Jr.

[11] 4,445,782

[45] May 1, 1984

[54] APPARATUS FOR SHAKING CONTAINED MIXTURES INCLUDING PAINT AND OTHER FLUID MATERIALS

[75] Inventor: Richard S. Sparrow, Jr., Norwell, Mass.

[73] Assignee: Peerless Pressed Metal, Inc., Watertown, Mass.

[21] Appl. No.: 412,436

[22] Filed: Aug. 27, 1982

[51] Int. Cl.[3] ..... B01F 9/00

[52] U.S. Cl. ..... 366/217; 366/605

[58] Field of Search ..... 220/314; 366/208, 209, 366/210, 211, 212, 213, 214, 216, 217, 347, 601, 605

[56] References Cited

U.S. PATENT DOCUMENTS

| | | | |
|---|---|---|---|
| 799,872 | 9/1905 | Schomber | 366/217 |
| 2,034,902 | 3/1936 | Heinze | 366/209 |
| 3,086,332 | 4/1963 | Wentz | 366/214 |
| 3,880,408 | 4/1975 | Karjalainen | 366/217 |
| 3,934,758 | 1/1976 | Kipp | 366/601 |
| 4,153,374 | 5/1979 | Adams | 366/208 |

*Primary Examiner*—Robert W. Jenkins
*Assistant Examiner*—Arthur D. Dahlberg
*Attorney, Agent, or Firm*—Hamilton, Brook, Smith & Reynolds

[57] ABSTRACT

Shaker apparatus for containers having paint mixtures therein includes a housing, U-shaped holder frame means supported in the housing, and clamping disks for detachably securing containers in the holder frame means. The U-shaped holder frames are mounted for rotation on power driven shaft means horizontally received in the housing. Drive means responsive to rotation of the U-shaped holder frame members about a horizontal axis is operable to turn the clamping disks about axes perpendicular to the said horizontal axis. The drive means includes rotatable sheave means having endless belts which are engageable with stationary sheave means. The stationary sheave means are fixed to the power driven shaft means and located in coaxial relationship therearound.

6 Claims, 24 Drawing Figures

6B
2
G2
40
44
C5
60
24
C2
58
C6
16
5
20
42
49B
22
50
6
44'
40
G1
6
6
42'
49A
C3
C1
10A
C4
14
6A

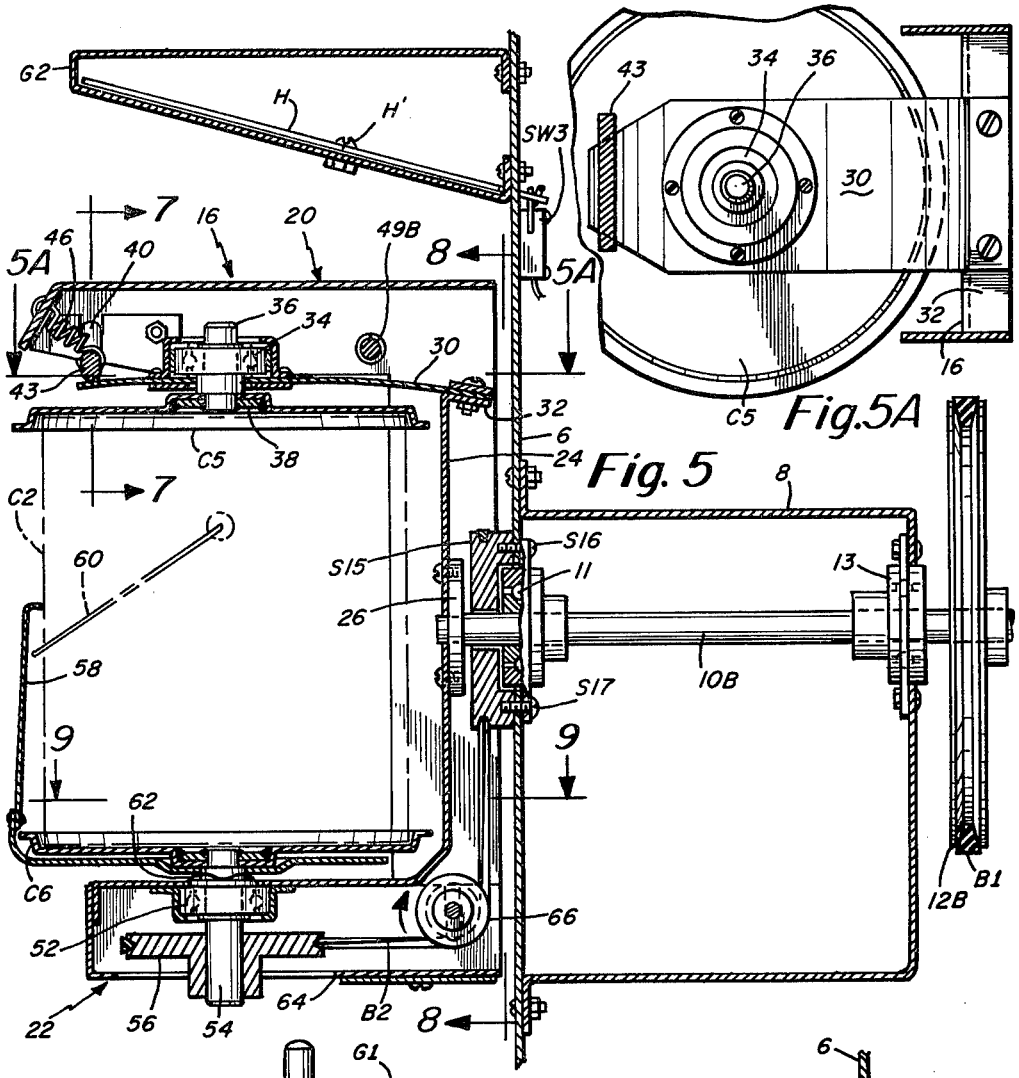
G2
H
H'
SW3
7
16
20
49B
8
5A
46
40
36
34
30
43
32
6
24
C5
38
C2
60
58
9
62
C6
52
22
56
54
64
B2
66
S15
S16
11
26
S17
10B
13
12B
B1
Fig. 5
Fig. 5A
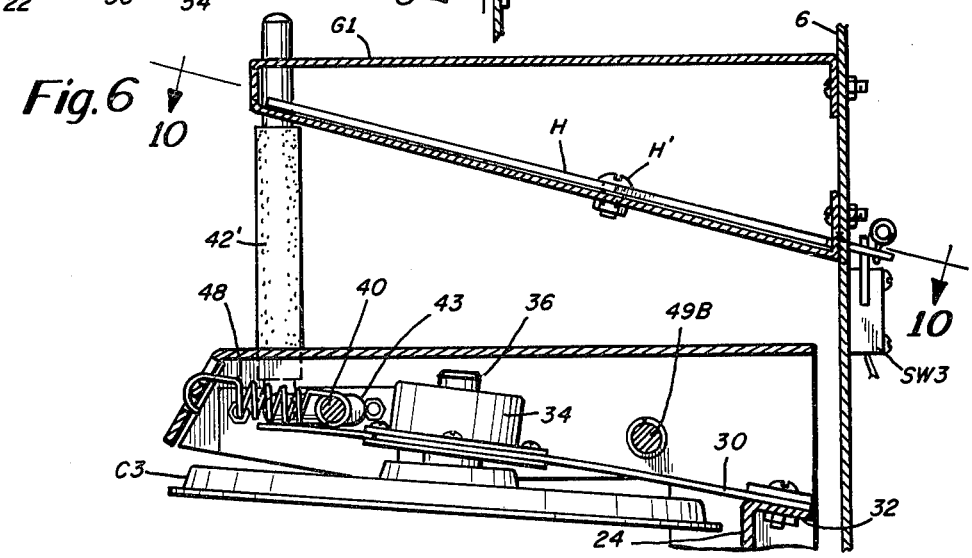
Fig. 6
10
G1
6
H
H'
42'
48
40
43
36
49B
34
30
C3
24
32
SW3

APPARATUS FOR SHAKING CONTAINED MIXTURES INCLUDING PAINT AND OTHER FLUID MATERIALS

FIELD OF THE INVENTION

Devices for shaking container bodies such as paint cans in which a mixture such as paint is received is well known in the art. Devices of this nature are employed especially in retail stores to meet the need of customers who wish to buy a paint which is ready mixed and suitable for immediate use. As the volume of sales in these retail stores may be very substantial, these conventional shakers are constantly being used and subjected to stresses which tend to cause wear and result in vibration of an undesirable nature. A common occurrence is the development of loosened parts in a shaker device and the cost of installation and servicing may be excessively high with undesirable interruption in use.

There exists therefore a need for a shaker having components so assembled and combined as to resist wear and breakdown over long periods of time.

SUMMARY OF THE INVENTION

The present invention relates to shaker apparatus of the class noted and is concerned with an improved assembly of parts characterized by a specially designed housing structure in which all of the parts are rigidly enclosed.

It is a chief object of the invention to provide a combination of shaker parts with a reinforced housing construction which is capable of withstanding stresses during relatively long periods of use with vibration being substantially controlled.

Another object is to devise in a shaker apparatus an arrangement of parts by which a contained fluid mixture may be simultaneously rotated about two axes of rotation occurring perpendicular to one another.

Another object is to provide a shaker apparatus having novel clamping means and locking handles for quickly and efficiently securing and releasing paint cans in the housing and securing paint can bails in a fixed position.

Still another object of the invention is to provide a clamping mechanism including locking handle means and electrical switch means responsive to movement of the locking handle means to provide safety in operation.

A still further object of the invention is to provide drive means in which rotating sheave means and stationary sheave means are syncronized so that for each revolution of a can of paint about a horizontal axis of rotation the can is simultaneously rotated through one revolution about axes perpendicular to the horizontal axis.

The nature of the invention and its objects and novel features will be more fully understood from a detailed description of the structure shown in the drawings.

BRIEF DESCRIPTION OF THE DRAWINGS

FIG. 5A is a plan cross-sectional view taken on the line 5A—5A of FIG. 5.

FIG. 6 is a cross-section taken on the line 6—6 of FIG. 3.

DETAILED DESCRIPTION OF THE INVENTION

The shaker apparatus of the invention, in one preferred embodiment, is constructed with dual units for use in receiving and shaking two containers such as paint cans simultaneously and is further designed for handling two containers of different sizes, as hereinafter disclosed.

Figure 1:
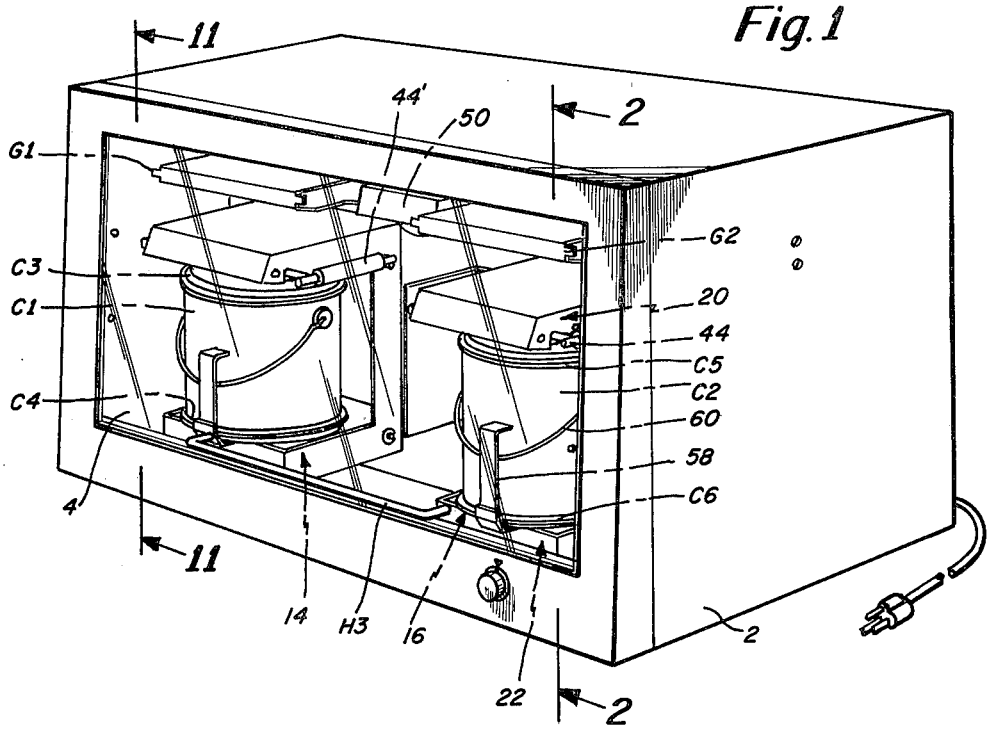
FIG. 1 is a perspective view illustrating the shaker apparatus of the invention and further illustrating container bodies supported therein.
Figure 2:
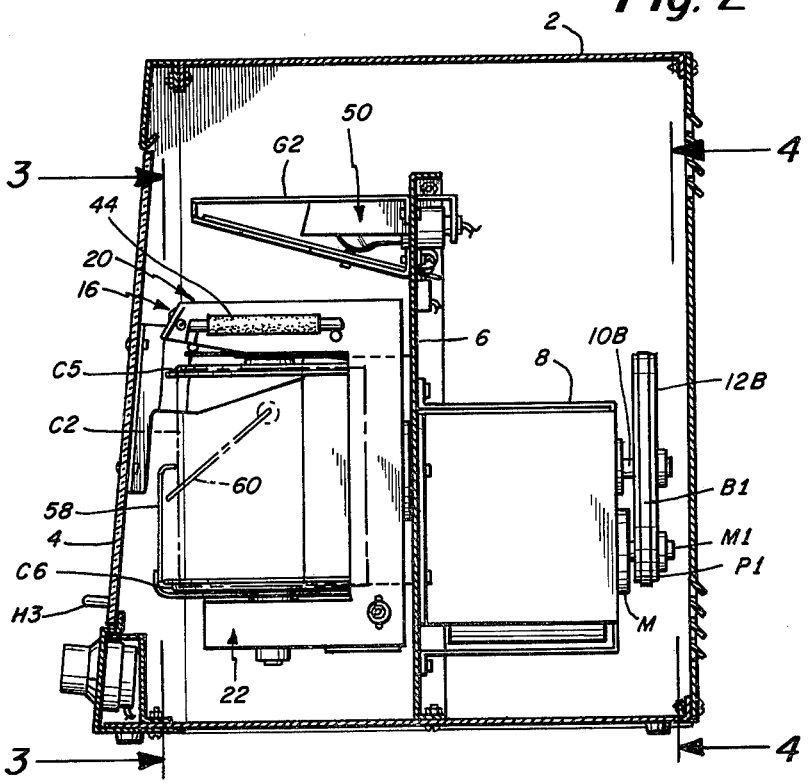
FIG. 2 is a cross-section taken on the line 2—2 of FIG. 1.
Figure 3:
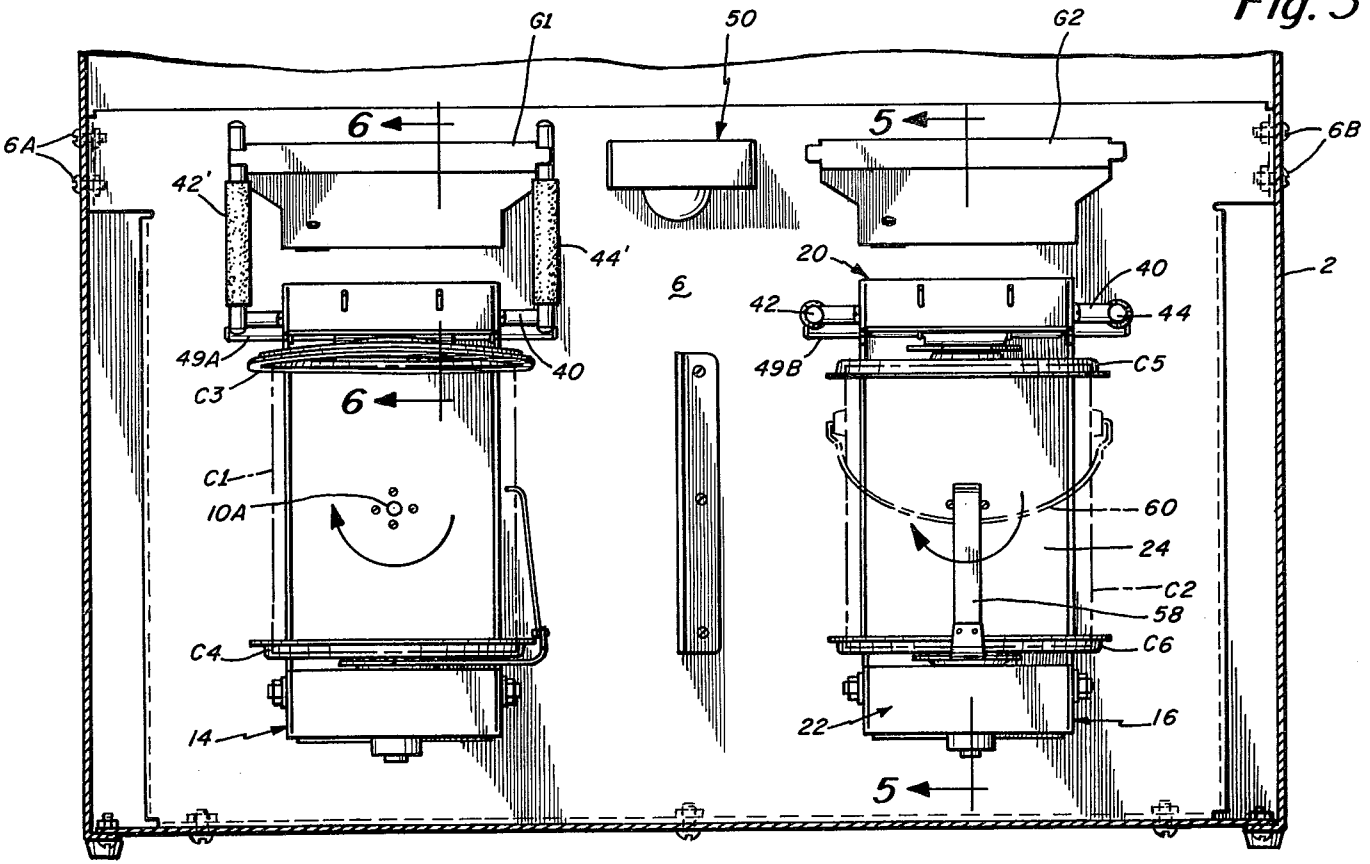
FIG. 3 is a cross-section taken on the line 3—3 of FIG. 2 and illustrating locking arms in two positions of adjustment.
Figure 4:
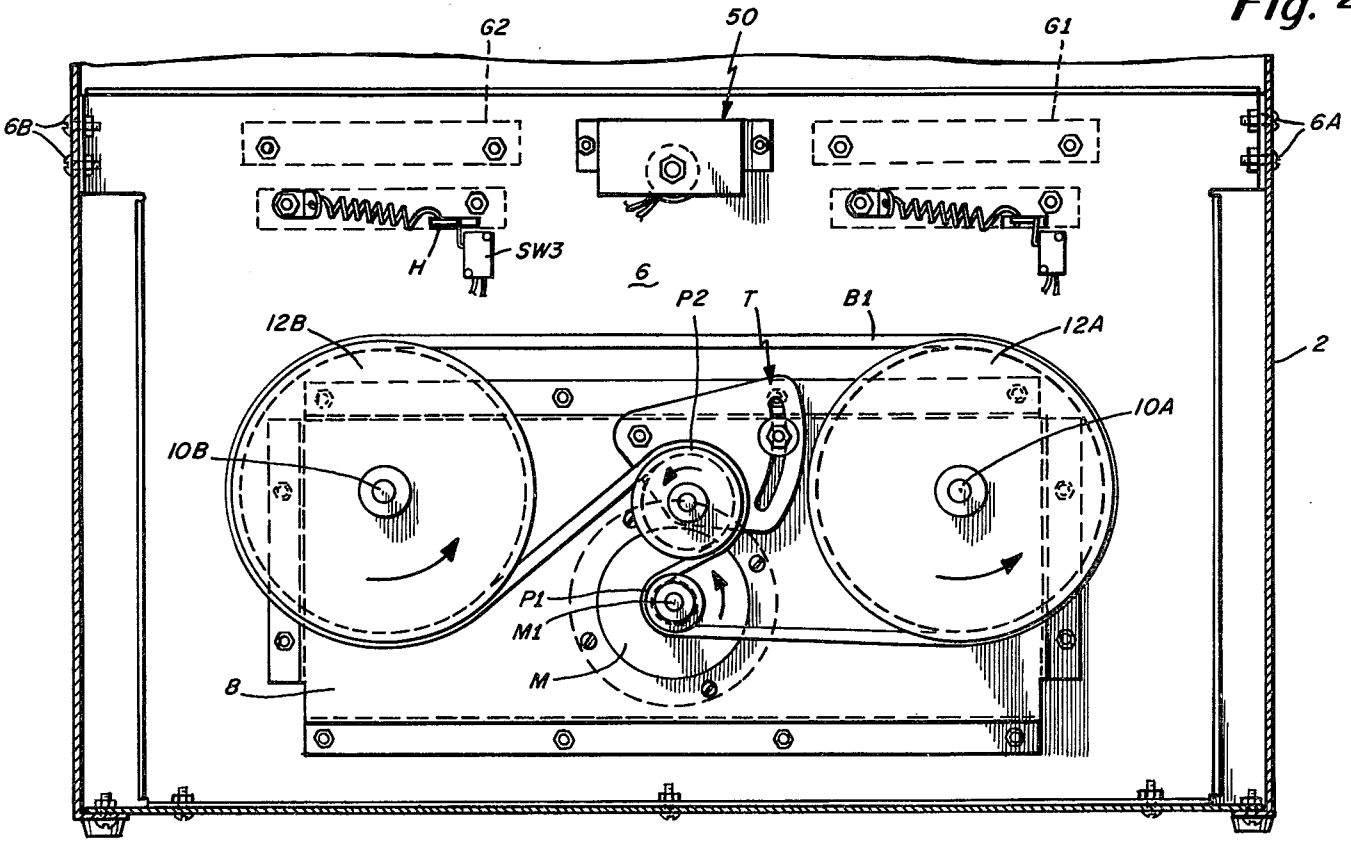
FIG. 4 is a cross-section taken on the line 5—5 of FIG. 3.

FIGS. 1, 3 and 4 illustrate dual shaker units of the invention which are of similar construction. Details of one of the shaker units are illustrated in FIGS. 2, 5, 5A, 6, 7, 8, 9, 10, 11, 12, 13 and 14. FIGS. 15–23 are views illustrating diagrammatically operation of the shaker apparatus.

Principal parts of the apparatus, in general, include (a) a housing body in which containers may be protectively enclosed within an illuminated interior; (b) U-shaped holder frame means supported in the housing; (c) clamping disks for detachably securing the containers in the U-shaped frame means; and (d) means for actuating movable parts.

As shown in FIG. 1, the dual shaker apparatus comprises a substantially box-shaped housing body having an access door hinged at one side thereof. Rigidly mounted in the housing 2 is a vertical retaining wall, shown in FIGS. 2 and 3 and denoted by the numeral 6. At its upper portion retaining wall 6 is secured between inner sides of the housing 2 by fastenings as 6A and 6B (FIG. 3), and has supported thereon inwardly projecting locking handle guide and stop structures generally denoted by arrows G1 and G2 and occurring in spaced apart relation at either side of a lamp shade and a bulb assembly, as shown in FIG. 3. Bolted or otherwise fastened to the retaining wall, at an opposite side and at a lower point, is a drive support structure 8, more clearly shown in FIGS. 4 and 5.

Received through the support structure 8 are shafts 10A and 10B mounted for rotation about horizontal axes and supported in suitable bearings, as for example bearings 11 and 13 for shaft 10B as shown in FIG. 5. Outer ends of shafts 10A and 10B extend through the support structure 8 and have fixed thereon pullys 12A and 12B, as is most clearly shown in FIG. 4. Also mounted in the support structure between pullys 12A and 12B is a motor M which is connected to an electrical power source and which has shaft M1 on which is fixed a pully P1. Located around the pullys 12A and 12B is a pully belt B1 which is also guided around pully P1 and idler pully P2. Idler pully P2 is provided with adjustable tensioning means T. The motor M, when energized, is operable to drive the shafts 10A and 10B through the pully and belt arrangement described at some desired speed.

An important feature of the invention is the combination, with the power driven shafts 10A and 10B, of U-shaped holder frames noted above together with top and bottom clamping disks in the U-shaped frame members. The frames are fixed to the power driven shafts 10A and 10B as noted below in more detail.

Attention is directed to FIGS. 1, 3 and 5 in which U-shaped holder frames generally indicated by arrows 14 and 16 are shown with paint containers C1 and C2 received therein and detachably secured by means of two sets of clamping disks. One set of clamping disks includes a bottom clamping disk C3 and a top clamping disk C4 shown at the right hand side of FIGS. 1 and 3. A second set of clamping disks includes a bottom clamping disk C5 and a top clamping disk C6 shown at the left hand side of FIGS. 1 and 3.

Figure 8:
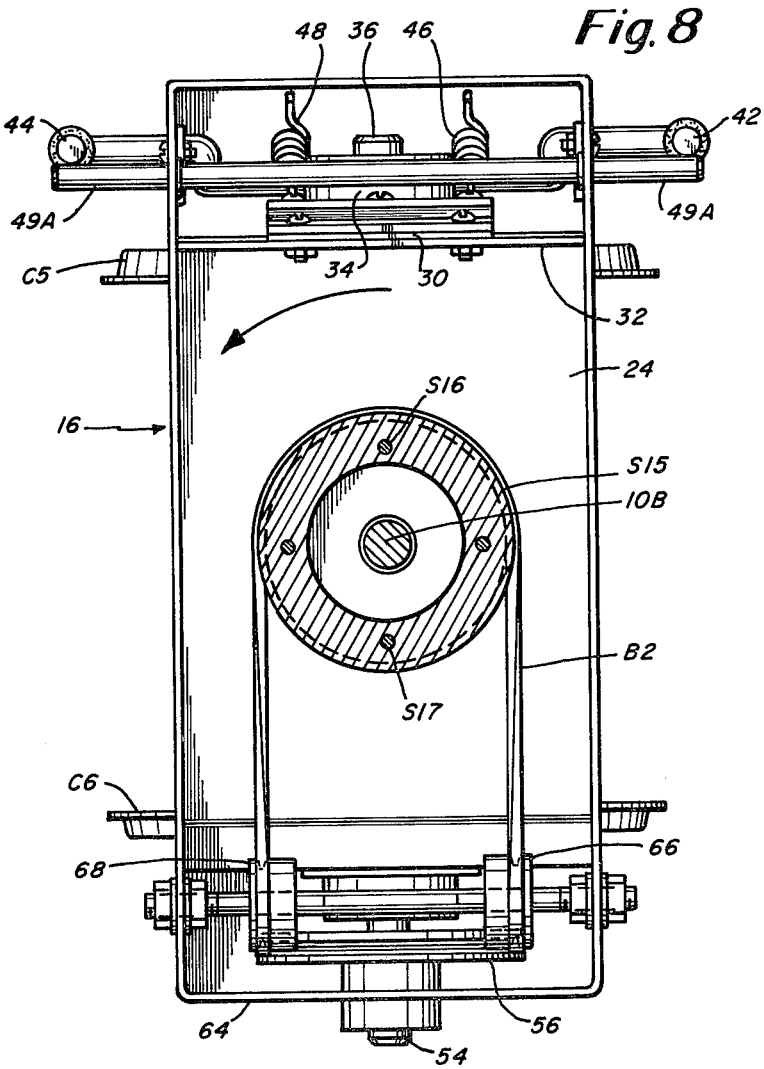
FIG. 8 is a cross-section taken on the line 8—8 of FIG. 5.

In FIGS. 5 and 8 there are illustrated details of construction and mounting of the holder frame 16 in accordance with the invention and it will be understood that the holder frame 14 is of similar construction. Each of the holder frames are in general of a U-shaped configuration as may be seen from an inspection of FIG. 1. Considering in further detail the holder frame 16 as shown in FIGS. 5 and 8, there is included in this holder frame structure a top section 20, a bottom section 22 and a vertical rear side 24 and these parts are arranged to provide a U-shaped configuration. Rear side 24 may be constructed from a relatively heavy gauge steel of substantial rigidity and as is best shown in FIG. 5 has solidly bolted to it a centrally located collar 26 in which is fixed an inner extremity of shaft 10B.

By means of this arrangement the entire holder frame 16 may be rotated about a horizontal axis as shaft 10B is driven by motor M. It is pointed out that the frame side 24 and collar 26 are located in close proximity to retaining wall 6 and bearing 13 to reduce undesirable torque forces from developing. In addition, the mounting of shaft 10B in wall 6 is strengthened and reinforced by the combination between the collar 26 and retaining wall 6 of a stationary sheave member S15, best shown in FIG. 5. This stationary sheave is solidly bolted to the wall 6 by fastenings S16 and S17 and is located in coaxially disposed relationship around the extended portion of shaft 10B. When the frame is rotated at a relatively high speed, as for example 300 to 350 rpm, there is achieved by the combination of parts as noted a balancing of forces which resists loosening of parts and is substantially free, and may be maintained substantially free, from vibration over extended periods of use.

In clamping a container in a position to undergo shaking, as well as removing a container after shaking has been completed, means are provided, in accordance with the invention, for adjusting the position of a top clamping disk. In FIG. 6 the top clamping disk C6, also shown in FIG. 5, is illustrated in a raised position which permits insertion or removal of a container such as container C2.

Figure 16:
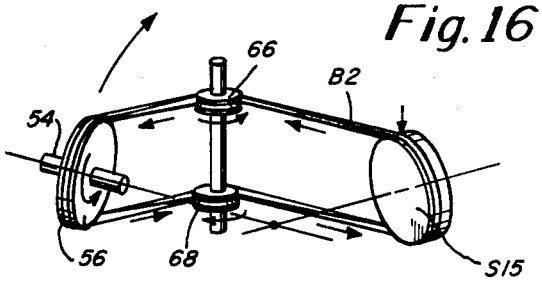
Figure 17:
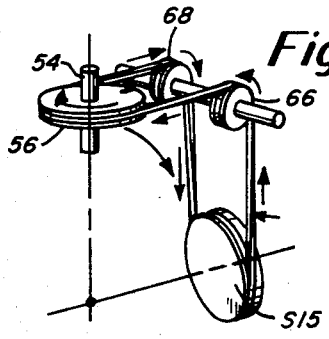
Figure 18:
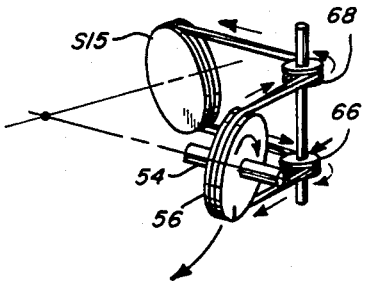
Figure 19:
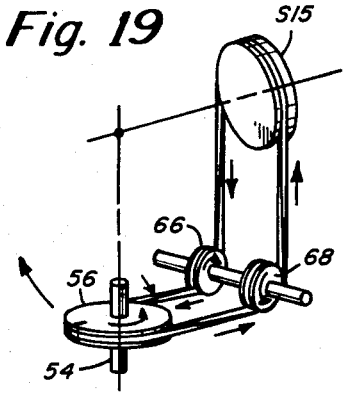
Figure 20:
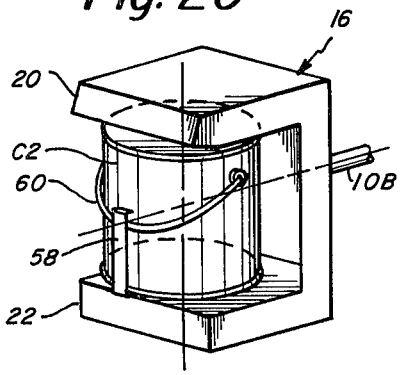
FIGS. 20 through 23 are diagrammatic views of positions assumed by a holder frame of the invention during one revolution about a horizontal axis.
Figure 21:
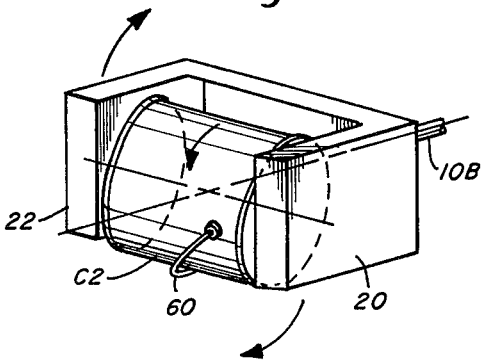
Figure 22:
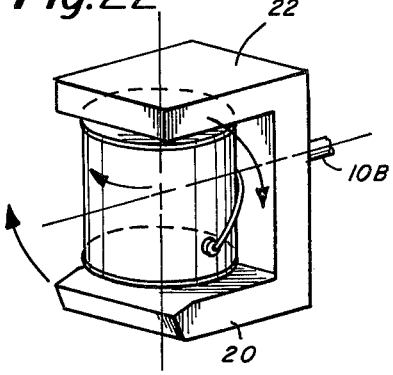
Figure 23:
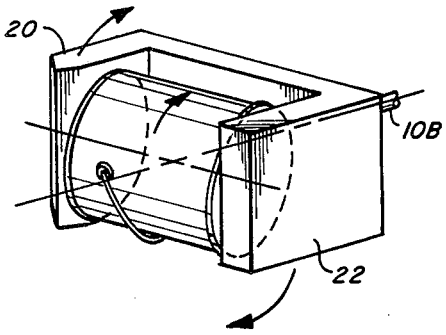

Positioning of the clamping disks C4 and C6 is carried out by invention adjustment devices which include respective resilient arms having disks supported therein and means including cam means for compressing the arms and respective supported disks into into engaged positions against paint containers in the U-shaped frames. There is also included locking handles for operating the cam means. One adjustment device for the U-shaped frame 16 has been illustrated in FIGS. 3, 5, 5A, 6, 7 and 8 and it is to be understood that reference characters applied to the components for 16 will be similar, but primed, for the adjustment devices present in frame 14. Resilient arm 30 constructed of spring steel, for example, is shown in FIG. 8 and is fastened to a flange part 32 of rear side 24 in a position such that it normally occurs in an angled position, as shown in FIG. 16. At an intermediate portion of arm 30 is a fixed bearing structure 34 in which a stub shaft 36 is freely rotatable. The lower end of shaft 36 is fast on a collar 38, in turn welded or otherwise secured to the clamping disk C6 to provide for free rotation of the disk when clamped against an underlying rotating container as C2.

Figure 7:
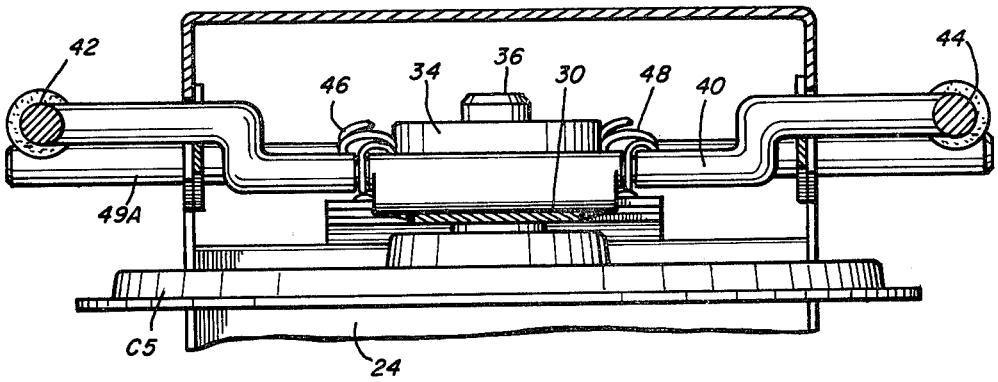
FIG. 7 is a cross-section taken on the line 7—7 of FIG. 5.

A spring loaded cam assembly is mounted through sides of the top section 20 of holder frame 16 for engagement with the inner end of arm 30, as has been suggested in FIG. 5 and also shown in FIG. 7. The cam assembly is further shown in FIG. 8 and and includes an offset shaft element 40 having opposite ends thereof received through the sides of the frame 20. Fixed to the extremities of the shaft element 40 are locking handles 42 and 44.

At an intermediate portion of element 40 is provided a cam part 43 and also attached to the element 40 are coiled springs as 48 and 46 which are anchored in the frame 20, as shown in FIGS. 7 and 8. In FIG. 6 locking handle 42 is shown in a raised position with the offset shaft element turned to allow the cam 43 to release the arm 30 into its normally angled position.

The extremities of handles 42 and 44 are further formed with reduced upper ends and these upper ends are arranged to engage against stop elements as 49C and 49D provided on guide structure G2 when the handles 42 and 44 are in a raised position. In FIG. 7, the locking handles 42 and 44 are shown rotated against the resistance of the springs 46 and 48 into a spring loaded locking position with the springs 46 and 48 exerting a force which maintains the handles in a locked position until the handles are forceably released. This locked position is due to the springs having gone over the central axis of pivoting of shaft 40.

Cooperating with the adjustable clamping disk C6 is a further invention arrangement of bottom disk C5 in the bottom section 22 of holder frame 16, as is most clearly shown in FIG. 5. As noted therein, the underside of section 22 is constructed with a bearing 52 through which is rotatably received a stub shaft 54 which is fastened by welding or other suitable means to the bottom clamping disk C5. At its lower end the shaft 54 has fixed thereto a rotatable sheave 56. A bail holder 58 is engaged with a bail 60, shown in FIG. 3, and has a bottom strap portion engaged against a wave-form washer 62, also shown in FIG. 9, to maintain the bail holder in a secured position.

Figure 9:
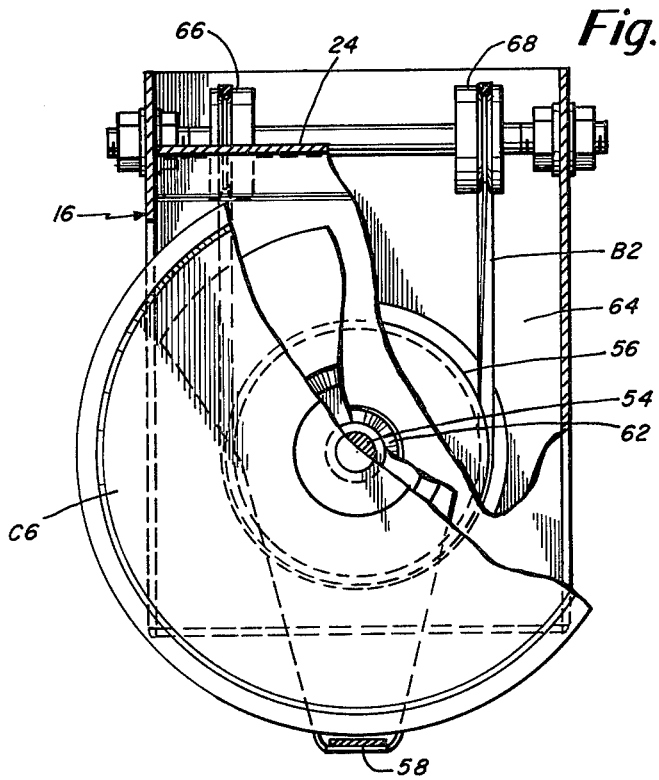
FIG. 9 is a cross-section taken on the line 9—9 of FIG. 5.

A belt member B2 is located around sheave 56 and is guided around guide pullys 66 and 68, as shown in FIG. 9, and then engaged around the stationary shaft S15.

A further desirable feature of the invention resides in constructing the stationary sheave S15 and the rotatable sheave 56 of similar circumferences and locating the stationary sheave S15 around the power driven shafts 10A and 10B in coaxial relationship. The two sheaves of similar circumferences are operatively connected by a belt as B1. Rotation of the holder frames with the power driven shaft means 10A and 10B produces traction forces and thus the sheave 56 and rotation of the shafts is syncronized so that for each revolution of the power driven shaft means about a horizontal axis, a holder frame such as 16 having clamped therein a container as C2 is rotated into positions as shown in FIGS. 20–23. Concurrently, the sheave 56 is caused to rotate through a single revolution. In FIGS. 15–19 inclusive there is illustrated diagrammatically the positions through which the sheave 56 is moved into making a single revolution and the directional arrows denote paths of travel of the belt B2 in moving around the sheave S15 and these figures illustrate the two axes of rotation occurring perpendicular to one another.

Figure 11:
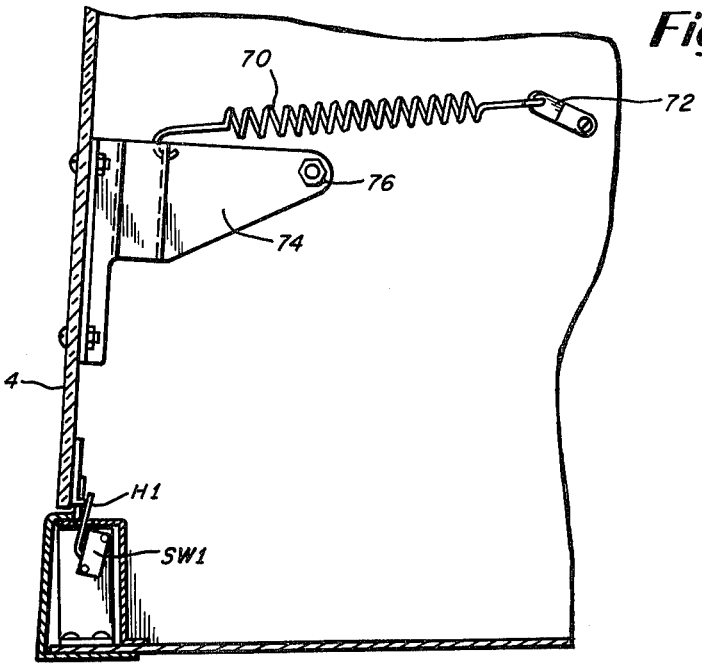
FIG. 11 is a detail fragmentary view of electrical control means.
Figure 12:
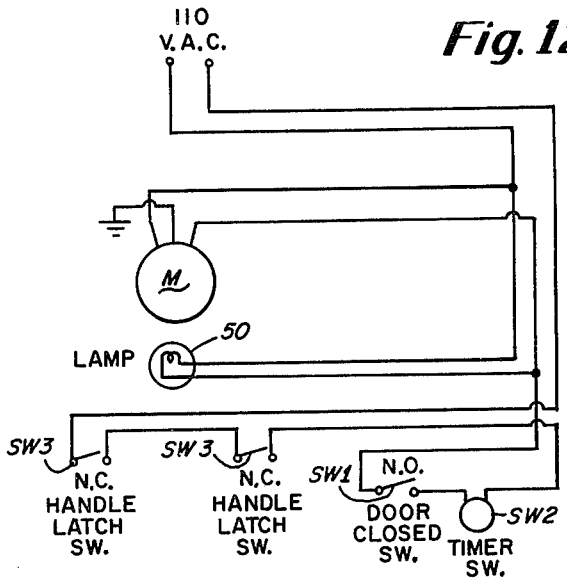
FIG. 12 is a schemmatic view of a wiring diagram of the invention.

In FIG. 12 there is illustrated diagrammatically electrical control switches for operating a motor M with safety provisions. One provision is to require that the door 4 be properly closed in order to close a circuit through the motor M. As shown in FIG. 12, the switch SW1 is a normally open switch which is supported in a box, as shown in FIG. 11, in a position to be forced into a closed position when door 4 is closed. Door 4 is provided with a hinge as 74, pivoted at 76 and resiliently held by spring means as 70 anchored to the bracket 72.

Figure 10:
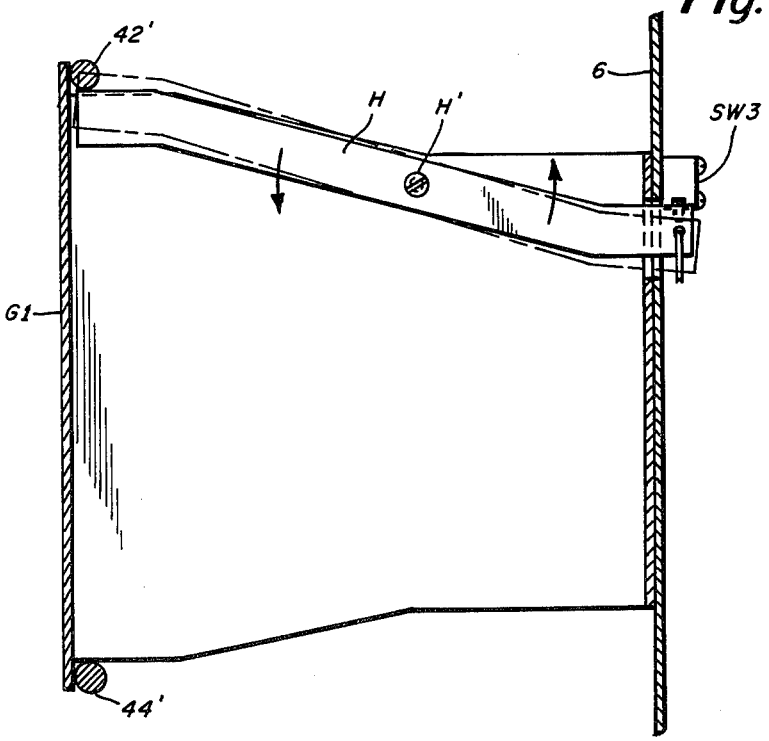
FIG. 10 is a cross-section taken on the line 10—10 of FIG. 6.

Also provided are additional safety switches as SW3 and SW4 which are actuated by a latch member as H, as shown in FIG. 10, and pivoted about a pivot point H1. As shown in FIG. 10, the locking handle 42, when moved into a locked position, comes into engagement with an angled edge of latch H and forces switch 3 into a closed position against the resistance of a spring H2. This insures that the locking handle must be in a fully closed position for the motor M to operate. When the handle 42 is raised, spring H2 opens the switch to prevent accidental operation.

There may also be provided a switch as SW2, also shown in FIG. 12, which is arranged to set the time period during which shaking is to be carried out by means of rotation of the motor M.

The clamping disks C5 and C6, shown in FIG. 5, engage with the container C2 and are suitable for use especially with one gallon paint cans as are frequently used to contain paint mixtures. However, as earlier noted, it may be desired to shake simultaneously a one gallon can and a one quart can, or a one pint can.

Figure 13:
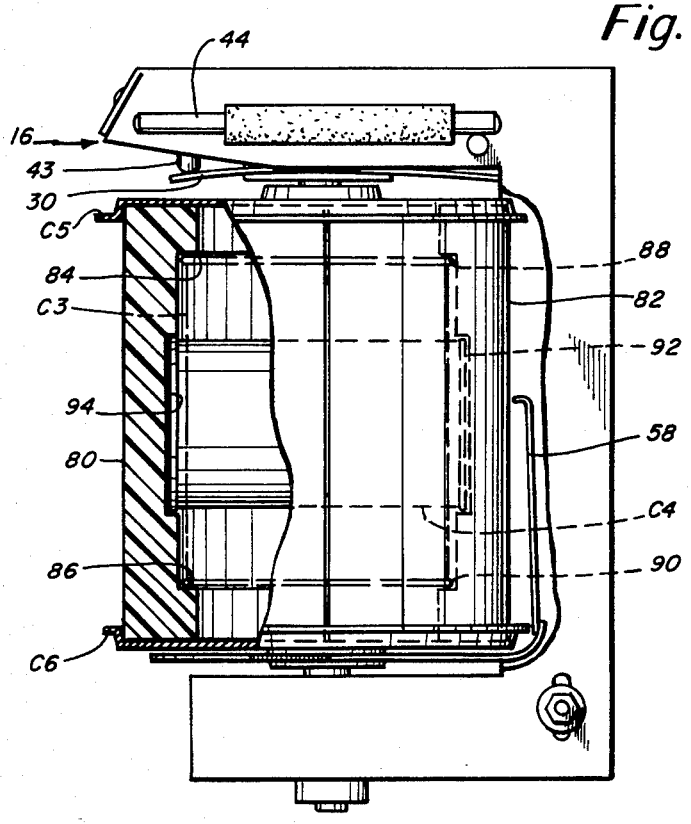
FIG. 13 is a detail elevational view, partly broken away, of the holder frame means with paint cans in a quart size and a second can in a pint size contained therein.
Figure 14:
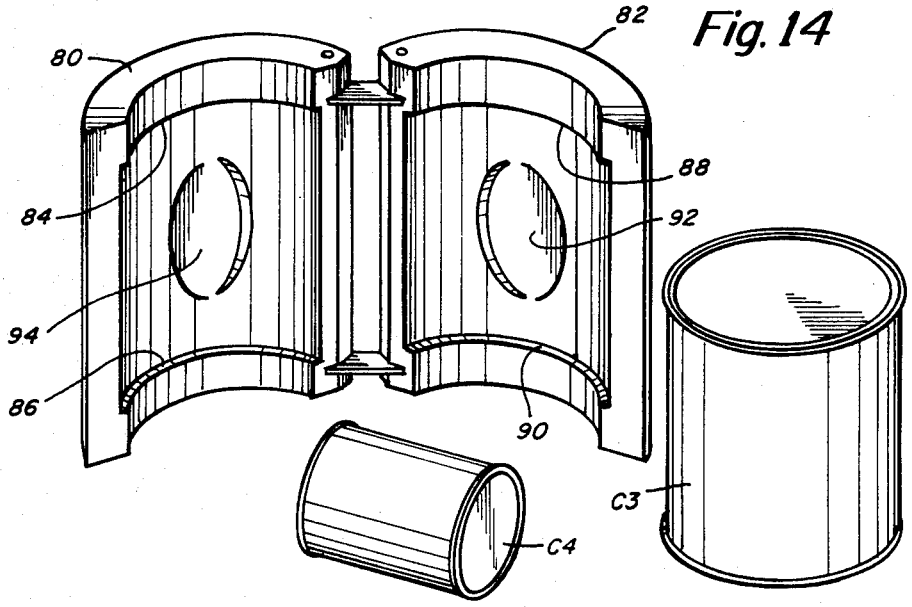
FIG. 14 is a detail view showing means for locking a quart size paint and a pint size paint can in place.
Figure 15:
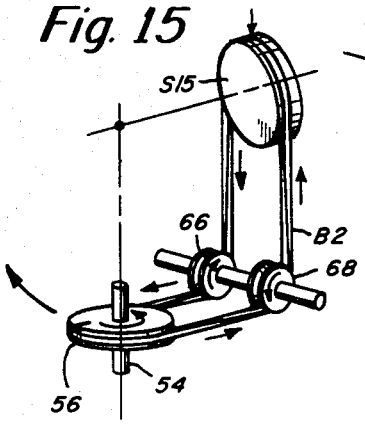
FIGS. 15 through 19 are schemmatic views illustrating rotative movement of a drive sheave of the invention in relation to a stationary sheave.

FIGS. 13 and 14 disclose hinged adapter means 80 and 82 which are recessed to provide gripping edges as 84, 86, 88 and 90 spaced apart to fit over top and bottom edges of a quart size paint can when the hing portions are closed and locked into place by the clamping disks C5 and C6. These hinged adapter parts may also be provided with recesses as 92 and 94 in which opposite ends of a pint size paint can can be tightly secured with the hinge parts when the hinge parts are closed.

I claim:

1. Apparatus for shaking a container provided with a bail and in which is received a fluid mixture including paint and other fluid materials, said apparatus including a housing having a vertical retaining wall rigidly secured at an intermediate portion thereof, a drive support structure mounted at an opposite side of the retaining wall at a lower point thereon, power driven motor and shaft means received through the drive support structure for rotation about a horizontal axis and having end portions extending through the vertical retaining wall, U-shaped holder frame means secured to the said end portions of the power driven shaft means for rotation therewith, said U-shaped holder frame means comprising a top section, a bottom section and a vertical rear side extending therebetween in which the said end portions of the shaft means is anchored, a lower clamping disk rotatably supported in the bottom section for receiving said container thereon, an adjustable upper clamping disk rotatable in the top section and movable into and out of resiliently maintained engagement with the said container supported on the said lower clamping disk, and said bottom section having mounted therein drive shaft means for turning the said upper clamping disk and container about axes perpendicular to the said horizontal axis of rotation, said drive means including bearing frame means fixed in the bottom section of the holder frame, stub shaft means rotatable in the bearing means and attached at one end to said lower clamping disk and at an opposite end to a belt driven sheave, a bail holder element engaged with the said bail of the container and being located in the bottom section around the stub shaft in resiliently held contact against the underside of the lower clamping disk.

2. Apparatus for shaking a container provided with a bail and in which is received a fluid mixture including paint and other fluid materials, said apparatus including a housing having a vertical retaining wall rigidly secured at an intermediate portion thereof, a locking handle guide and stop structure fastened to the top of the retaining wall at one side thereof, a drive support structure mounted at an opposite side of the retaining wall at a lower point thereon, power driven motor and shaft means about a horizontal axis and having end portions extending through the vertical retaining wall, U-shaped holder frame means secured to the said end portions of the power driven shaft means for rotation therewith, said U-shaped holder frame means comprising a top section, a bottom section and a vertical rear side extending therebetween in which the said end portions of the shaft means is anchored, a lower clamping disk rotatably supported in the bottom section for receiving said container thereon, an adjustable upper clamping disk rotatable in the top section and movable into and out of resiliently maintained engagement with the said container supported on the said lower clamping disk, said adjustable clamping disk including a resilient suspension arm having a bearing member supported therein, a stub shaft fixed to the adjustable clamping disk freely rotatable in the bearing and means for moving the adjustable clamping disk into and out of engagement with the container.

3. The invention of claim 2 in which the resilient suspension arm is anchored to the top of the rear side of the U-shaped frame means in an upwardly angled position to normally locate the adjustable disk in a raised position.

4. The invention of claim 3, further characterized in that the means for moving the adjustable clamping disk consists in a shaft member rotatably mounted in the said top section of the holder frame and having a cam part fixed to an intermediate portion thereof and locking handle parts fixed to the outer ends of the said shaft for rotating the shaft and moving the cam part against an end of the resilient suspension arm into a compressed position in which the adjustable clamping disk is firmly engaged against the top of the said container.

5. The invention of claim 4 in which spring means are attached to the shaft and anchored to an inner side of the said top section to resiliently hold the shaft cam part in locked relation with the compressed suspension arm.

6. The invention of claim 5 including safety switch means attached to the said vertical retaining wall and said locking handles being provided at one side thereof with a pivoted latch switch operable to close a circuit through the power driven motor when the locking handles are moved against the latch.

* * * * *